US009604236B2

(12) United States Patent
Sandahl et al.

(10) Patent No.: US 9,604,236 B2
(45) Date of Patent: Mar. 28, 2017

(54) FLUID INTAKE ASSEMBLY FOR A FLUID SPRAYER

(76) Inventors: Jeffrey E. Sandahl, Buffalo, MN (US); Jeffrey M. Smith, Elko New Market, MN (US)

( * ) Notice: Subject to any disclaimer, the term of this patent is extended or adjusted under 35 U.S.C. 154(b) by 737 days.

(21) Appl. No.: 12/774,504

(22) Filed: May 5, 2010

(65) Prior Publication Data

US 2011/0240765 A1 Oct. 6, 2011

Related U.S. Application Data

(63) Continuation-in-part of application No. 12/754,370, filed on Apr. 5, 2010, now abandoned.

(51) Int. Cl.

| | |
|---|---|
| ***B05B 9/00*** | (2006.01) |
| ***B05B 9/08*** | (2006.01) |
| ***B05B 9/04*** | (2006.01) |
| ***B05B 15/00*** | (2006.01) |

(52) U.S. Cl.

CPC ..... *B05B 9/0861* (2013.01); *B05B 9/0426* (2013.01); *B05B 15/005* (2013.01); *Y10T 29/49826* (2015.01)

(58) Field of Classification Search

CPC ... B05B 9/0413; B05B 9/0426; B05B 9/0861; B05B 7/2464

USPC .... 138/39; 239/302; 222/377, 375, 379, 382

See application file for complete search history.

(56) References Cited

U.S. PATENT DOCUMENTS

| | | | | |
|---|---|---|---|---|
| 1,843,269 | A | | 3/1929 | Casper |
| 1,839,193 | A | | 1/1932 | Blanchard |
| 1,972,955 | A | | 9/1934 | Saugman |
| 2,641,365 | A | | 6/1953 | Lundeen |
| 2,858,965 | A | * | 11/1958 | Berman ..... 222/333 |
| 3,623,661 | A | | 11/1971 | Wagner |
| 3,714,967 | A | | 2/1973 | Zupan et al. |
| 4,093,107 | A | | 6/1978 | Allman et al. |
| 4,147,306 | A | | 4/1979 | Bennett |
| 4,156,505 | A | | 5/1979 | Bennett |
| 4,184,778 | A | | 1/1980 | Terrels |

(Continued)

FOREIGN PATENT DOCUMENTS

| | | | |
|---|---|---|---|
| CA | 2568141 | A1 | 5/2008 |
| CN | 1450937 | A | 10/2003 |

(Continued)

OTHER PUBLICATIONS

International Search Report and Written Opinion for corresponding PCT application PCT/US2011/027876, dated Jul. 7, 2011.

(Continued)

*Primary Examiner* — Arthur O Hall
*Assistant Examiner* — Viet Le
(74) *Attorney, Agent, or Firm* — Katherine M Scholz; Kelly, Holt & Christenson PLLC

(57) ABSTRACT

In one example, a fluid intake assembly configured to provide an inlet fluid path for a fluid sprayer is provided. The assembly includes a fluid intake assembly body configured to be removably engaged to a portion of the fluid sprayer by rotating the body with respect to the portion of the fluid sprayer. The assembly also includes a fluid inlet tube configured to be supported by the body and extend from the body within a fluid container to provide fluid flow along the inlet fluid path.

16 Claims, 10 Drawing Sheets

(56) References Cited

U.S. PATENT DOCUMENTS

| | | | | |
|---|---|---|---|---|
| 4,260,107 | A * | 4/1981 | Jackson | 239/74 |
| 4,315,317 | A | 2/1982 | Orchard et al. | |
| 4,405,088 | A | 9/1983 | Gray | |
| 4,467,961 | A | 8/1984 | Coffee et al. | |
| 4,705,995 | A | 11/1987 | Boll | |
| 4,782,982 | A | 11/1988 | Ellison | |
| 4,804,109 | A | 2/1989 | Vanderjagt | |
| 4,919,650 | A | 4/1990 | Feingold et al. | |
| 5,027,661 | A | 7/1991 | Desaulniers et al. | |
| 5,086,491 | A | 2/1992 | Cuneo | |
| 5,395,051 | A | 3/1995 | Anderson et al. | |
| 5,443,569 | A | 8/1995 | Uehira et al. | |
| 5,574,657 | A | 11/1996 | Tofte et al. | |
| 5,626,259 | A | 5/1997 | Maas et al. | |
| 5,639,219 | A | 6/1997 | Conatser | |
| 5,860,574 | A | 1/1999 | Shanklin et al. | |
| 5,979,715 | A * | 11/1999 | Emrick | 222/464.4 |
| 6,104,105 | A | 8/2000 | Schaeffeler et al. | |
| 6,207,052 | B1 * | 3/2001 | Webb | 210/321.75 |
| 6,488,846 | B1 | 12/2002 | Marangi | |
| 6,540,119 | B1 * | 4/2003 | Bensussan et al. | 222/464.3 |
| 6,719,058 | B2 * | 4/2004 | Salama et al. | 166/367 |
| 6,752,330 | B2 | 6/2004 | DiMaggio et al. | |
| 6,805,306 | B1 * | 10/2004 | Huang | 239/375 |
| 6,821,096 | B2 | 11/2004 | Kosmyna et al. | |
| 6,833,072 | B1 | 12/2004 | Krestine et al. | |
| 6,935,542 | B2 | 8/2005 | Harrity et al. | |
| 7,102,303 | B2 | 9/2006 | Brotto | |
| 7,446,493 | B2 | 11/2008 | Forster et al. | |
| 7,559,438 | B2 | 7/2009 | Kosmyna et al. | |
| 7,631,789 | B2 | 12/2009 | Dodd et al. | |
| 8,919,669 | B2 | 12/2014 | Sandahl | |
| 9,038,923 | B2 | 5/2015 | Robens et al. | |
| 2004/0262417 | A1 | 12/2004 | Proch | |
| 2005/0150521 | A1 | 7/2005 | Jones et al. | |
| 2005/0236498 | A1 | 10/2005 | Cunningham | |
| 2006/0049099 | A1 | 3/2006 | Chang | |
| 2007/0000948 | A1 | 1/2007 | Adler et al. | |
| 2007/0272764 | A1 | 11/2007 | Poulard | |
| 2008/0217361 | A1 * | 9/2008 | Vitantonio et al. | 222/399 |
| 2011/0240764 | A1 | 10/2011 | Sandahl | |

FOREIGN PATENT DOCUMENTS

| | | |
|---|---|---|
| DE | 43 10 014 | 9/1994 |
| EP | 1 889 665 | 2/2008 |
| FR | 2 602 437 | 2/1988 |
| FR | 2861460 A1 | 4/2005 |
| GB | 1176840 | 1/1970 |
| PT | 1655584 E | 6/2009 |
| WO | 02/07897 | 1/2002 |
| WO | 2010047800 | 4/2010 |

OTHER PUBLICATIONS

International Search Report and Written Opinion for PCT application PCT/US2011/027875, dated Jul. 8, 2011.

Titan Airless Spray Technology Pro-Finish Series Manual Dec. 1999, 6 pages.

Wagner Optimus Plus Project Painter Owner's Manual, http://www.wangnersspraytech.com, 19 pages, dated Jan. 2009.

U.S. Appl. No. 12/754,370, filed Apr. 5, 2010 Application and Drawings 21 pages.

U.S. Appl. No. 12/754,379, filed Apr. 5, 2010 Application and Drawings 17 pages.

Prosecution for U.S. Appl. No. 12/754,209, filed Apr. 5, 2010, including: Restriction Requirement dated Jun. 8, 2012, 6 pages; Response to Restriction Requirement filed Jun. 22, 2012, 5 pages; Non-Final Office Action dated Oct. 24, 2012, 14 pages; Amendment filed Jan. 11, 2013, 9 pages; Final Office Action dated Apr. 29, 2013, 15 pages; Amendment with RCE filed May 30, 2013, 11 pages; 60 total pages of prosecution history.

"Epic Integrated Controls", Epic Solutions, accessed Dec. 16, 2009, <www.epicsolutions.us/controls.html#m7>, 11 pages.

International Search Report and Written Opinion for PCT Application No. PCT/US2011/027870, dated Sep. 9, 2011, 14 pages.

Office Action from U.S. Appl. No. 12/754,209, dated Sep. 8, 2014. 19 pages.

Prosecution History from U.S. Appl. No. 12/754,379, including Requirement for Restriction/Election dated Aug. 15, 2012, Response to Election Restriction Requirement filed Sep. 6, 2012, Non-final Rejection dated Dec. 5, 2012, Amendment filed Feb. 4, 2013, Final Rejection dated Jul. 17, 2013, and Amendment with RCE filed Oct. 14, 2013, 56 pages.

Application and Drawings from U.S. Appl. No. 12/754,209, filed Apr. 5, 2010. 20 pages.

First Office Action from Chinese Patent Application No. 201180017645.0, Issue Date: Sep. 2, 2014. 11 pages with English Translation.

Prosecution History for U.S. Appl. No. 12/754,379 including: Issue Notification dated Dec. 10, 2014 and Notice of Allowance dated Oct. 29, 2014. 12 pages.

First Office Action from Chinese Patent Application No. 201180017649.9. Issue Date Oct. 23, 2014, 14 pages with English Translation.

Amendment from U.S. Appl. No. 12/754,209 dated Dec. 4, 2014, 11 pages.

First Office Action from Chinese Patent Application No. 201180017190.2, Issue Date: Nov. 3, 2014, 13 pages with English Translation.

Issue Notification dated May 6, 2005 and Notice of Allowance dated Mar. 20, 2015 for U.S. Appl. No. 12/754,209, 11 pages.

Third Office Action for Chinese Patent Application No. 201180017645.0 dated Sep. 22, 2015, 7 pages.

Second Office Action for Chinese Patent Application No. 201180017645.0 dated Mar. 24, 2015, 8 pages, with English Translation.

Third Office Action for Chinese Patent Application No. 201160017649.9, dated Dec. 16, 2015, 7 pages with English Translation.

Third Office Action for Chinese Patent Application No. 201180017190.2 dated Nov. 10, 2015, 7 pages. No English Translation Available.

* cited by examiner

FLUID INTAKE ASSEMBLY FOR A FLUID SPRAYER

CROSS-REFERENCE TO RELATED APPLICATION

The present application is a continuation-in-part of and claims priority of U.S. patent application Ser. No. 12/754,370, filed Apr. 5, 2010, the content of which is hereby incorporated by reference in its entirety.

BACKGROUND

An exemplary fluid sprayer comprises a spray-coating system having a device configured to spray fluid material (e.g., paint, ink, varnish, stain, texture, herbicides, pesticides, food products, etc.) through the air onto a surface. The fluid material is typically provided from a fluid container by a fluid intake assembly. Fluid intake assemblies can use pressure feed, gravity feed, and/or suction feed mechanisms, for example. In one exemplary airless paint spraying system, a suction tube assembly extends into a paint container to provide paint material to a pump mechanism, which delivers pressurized paint to an output nozzle or tip.

In airless fluid spraying systems and the like, air within the fluid flow can cause sputtering or spitting of the paint material and uneven spray from the output nozzle. Such results are undesirable to the user.

The discussion above is merely provided for general background information and is not intended to be used as an aid in determining the scope of the claimed subject matter.

SUMMARY

In one exemplary embodiment, a fluid intake assembly configured to provide an inlet fluid path for a fluid sprayer is provided. The assembly includes a fluid intake assembly body configured to be removably engaged to a portion of the fluid sprayer by rotating the body with respect to the portion of the fluid sprayer. The assembly also includes a fluid inlet tube configured to be supported by the body and extend from the body and within a fluid container to provide fluid flow along the inlet fluid path.

In one exemplary embodiment, an airless fluid sprayer is provided and includes a fluid intake assembly configured to provide an inlet fluid path from a fluid container and a fluid intake assembly mounting mechanism to which the fluid intake assembly is removably couplable such that a fluid tip extending from the fluid intake assembly is received within a fluid inlet port of the fluid sprayer.

In one exemplary embodiment, a method of securing a fluid intake assembly to a fluid sprayer is provided. The method includes engaging the fluid intake assembly to a portion of the fluid sprayer. The fluid intake assembly includes a fluid tip extending toward the portion of the fluid sprayer. The fluid tip is aligned with a fluid inlet port of the fluid sprayer. The method also includes rotating the fluid intake assembly with respect to the portion of the fluid sprayer such that the fluid tip is inserted into and forms a sealing engagement with the fluid inlet port.

These and various other features and advantages will be apparent from a reading of the following Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Figure 1:
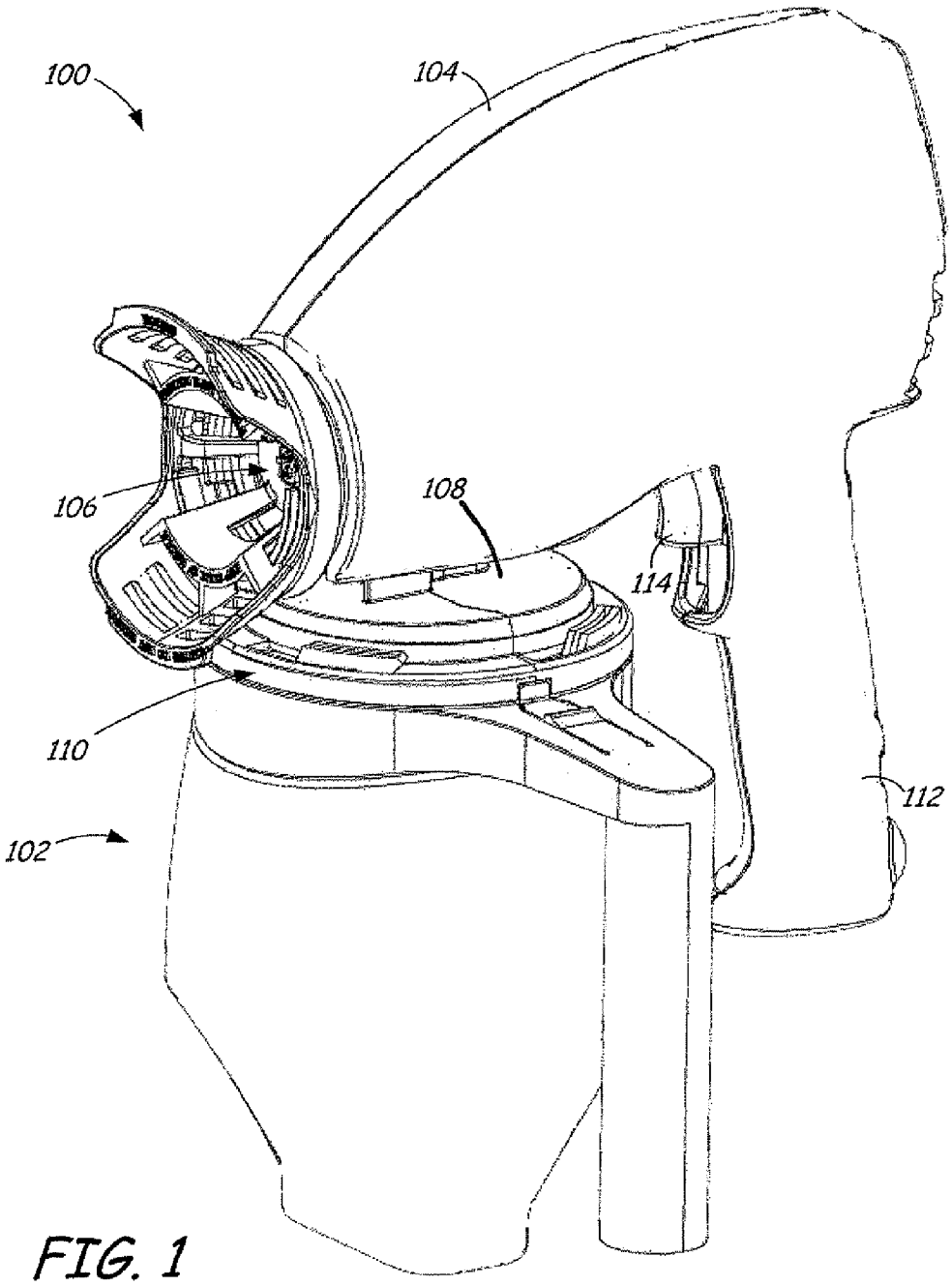
FIG. 1 is a perspective view of a fluid sprayer, under one embodiment.

FIG. 1 illustrates a fluid sprayer 100 configured to spray a fluid material, supplied from a fluid container, through the air onto a surface. As used herein, "fluid material" refers to a liquid material such as, but not limited to, paints, varnishes, stains, food products, pesticides, inks, and the like. In the embodiment illustrated in FIG. 1, sprayer 100 comprises a handheld paint spray gun configured to spray atomized paint materials; however, sprayer 100 can include other configurations and can be utilized to spray other types of fluid material.

Spray gun 100 illustratively comprises an airless system and uses a pump mechanism for pumping the paint material from a paint source, illustratively a fluid container 102. In other embodiments, spray gun 100 can comprise an air-driven or air-assisted system.

Spray gun 100 includes a body comprising a housing 104 containing electrical components for controlling operation of sprayer 100 and an electric drive or motor operably coupled to drive a pump mechanism. The pump mechanism delivers paint from container 102 to an output nozzle 106 having a particular size and shape for generating a desired spray pattern. A fluid intake assembly (not shown in FIG. 1) is positioned within container 102. The fluid intake assembly includes an inlet end for receiving paint from the container 102. The fluid intake assembly provides a fluid path from container 102 to housing 104. In one embodiment, the fluid intake assembly comprises a suction tube assembly that extends into housing 104 and/or is attached to a portion of a fluid container cover 108. Cover 108 is supported by housing 104 and/or motor/pump assembly disposed within housing 104. While embodiments herein are described in the context of a suction tube assembly, it is noted that concepts described herein can be used with other types of fluid mechanisms such as, but not limited to, pressure feed mechanisms, gravity feed mechanisms, and/or other types of mechanisms.

Spray gun 100 also includes a handle 112 and a trigger 114 that enable a user to hold and control the operation of spray gun 100. A power source (not shown in FIG. 1) supplies power for spray gun 100. For example, the power source can comprise a power cord connected to an AC power source, such as a wall outlet. In another example, the power source can comprise a battery pack. An exemplary battery pack can include primary (e.g., non-rechargeable) batteries and/or secondary (e.g., rechargeable) batteries. The battery pack can be mounted to spray gun 100 (for example, to handle 112) or can be external and connected to spray gun 100 through a power cord.

Container 102 is removably attached to cover 108 using a connection mechanism (generally illustrated by reference numeral 110), thereby allowing container 102 to be removed for filling, cleaning, etc. In one example, container 102 can be removed from cover 108 and reattached in a different orientation or replaced with a different container, for instance.

In conventional spraying devices and systems, when a container is removed (for example to refill the container) the fluid intake or inlet (e.g., a suction tube, etc.) is removed from the container. The fluid intake or inlet is pulled out of any remaining fluid in the fluid container and is exposed to air. During subsequent use, the air in the system can cause undesired sputtering or spitting of the fluid.

Figure 2:
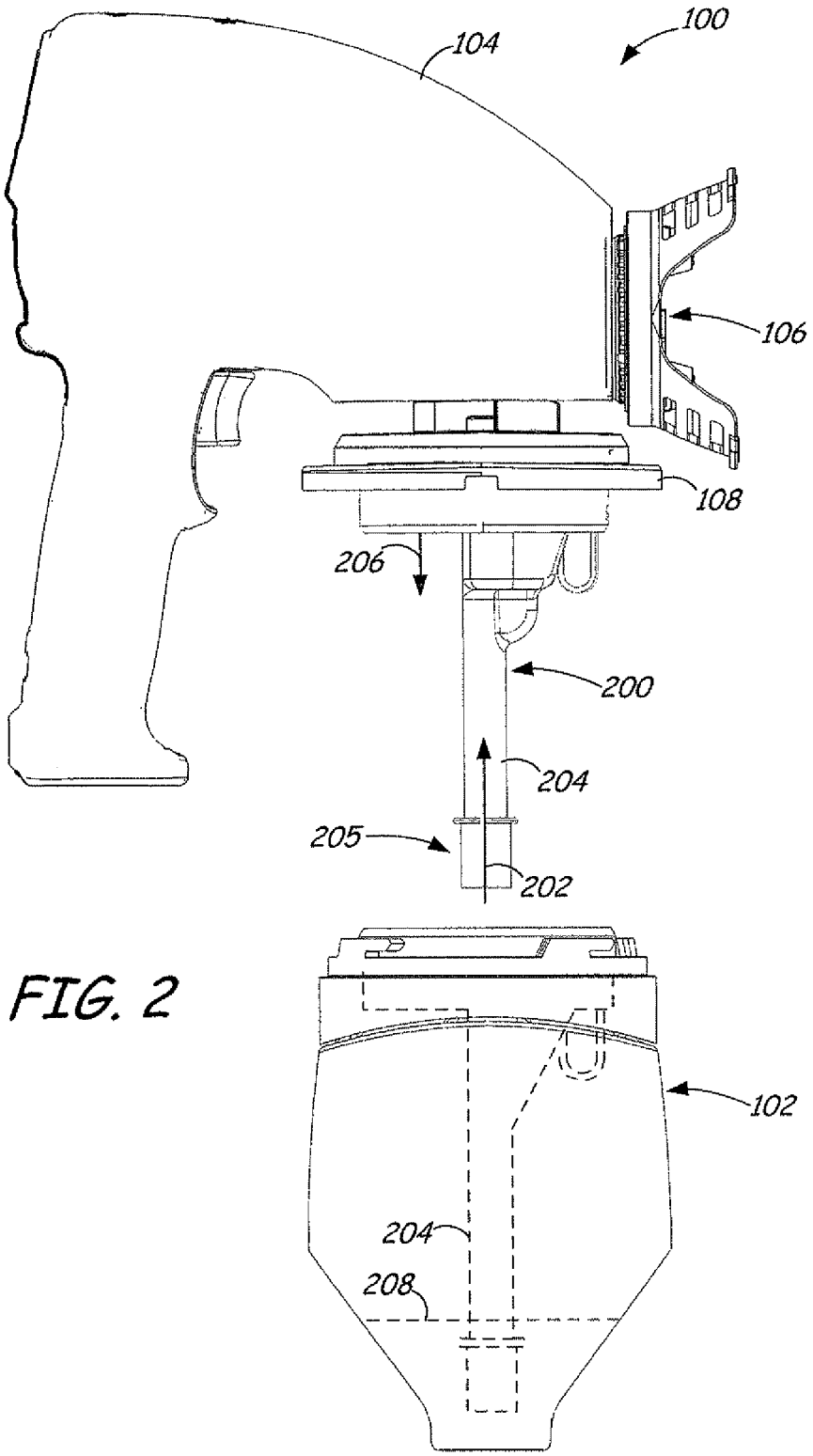
FIG. 2 is a side view of a fluid sprayer illustrating a fluid intake assembly, under one embodiment.

FIG. 2 illustrates one embodiment of a fluid intake assembly (illustratively a suction tube assembly) 200 configured to prevent or otherwise limit air (and/or other gasses) from entering the inlet fluid path (generally represented by arrow 202). FIG. 2 illustrates container 102 removed from cover 108 of spray gun 100. The inlet fluid path 202 through inlet suction tube 204 provides fluid to the fluid pump mechanism in housing 104. In one embodiment, a return fluid path (generally represented by arrow 206) is provided from spray gun 100 to fluid container 102. For instance, a port (not shown in FIG. 2) can be provided through cover 108 to allow a return flow of paint to container 102, for example during priming of spray gun 100.

By way of example, during a paint spraying application the inlet end 205 of suction tube 204 is disposed in fluid 208 in container 102. This is illustrated in FIG. 2 by dashed lines. The user suspends operation of spray gun 100 to refill container 102 (for example, when the level of paint in container 102 reaches a particular level). In one example, a fluid level indicator is provided on spray gun 100 indicating to the user that the fluid level in the container is at or below a threshold level. One example of a fluid level indicator is described in commonly assigned, co-pending U.S. patent application Ser. No. 12/754,209, filed on Apr. 5, 2010, and titled FLUID LEVEL INDICATOR IN AN AIRLESS FLUID SPRAYER, which is hereby incorporated by reference in its entirety.

As illustrated in FIG. 2, the user decouples container 102 from cover 108 of spray gun 100, which removes assembly 200 from the remaining fluid 208 in container 102. In accordance with embodiments described below, assembly 200 comprises mechanism(s) configured to prevent or otherwise limit air from entering the inlet fluid path 202. During subsequent use (i.e., after the container has been refilled and reattached to cover 108 of spray gun 100), the spray application can be resumed with little or no sputtering or spitting of fluid from nozzle 106.

Figure 3:
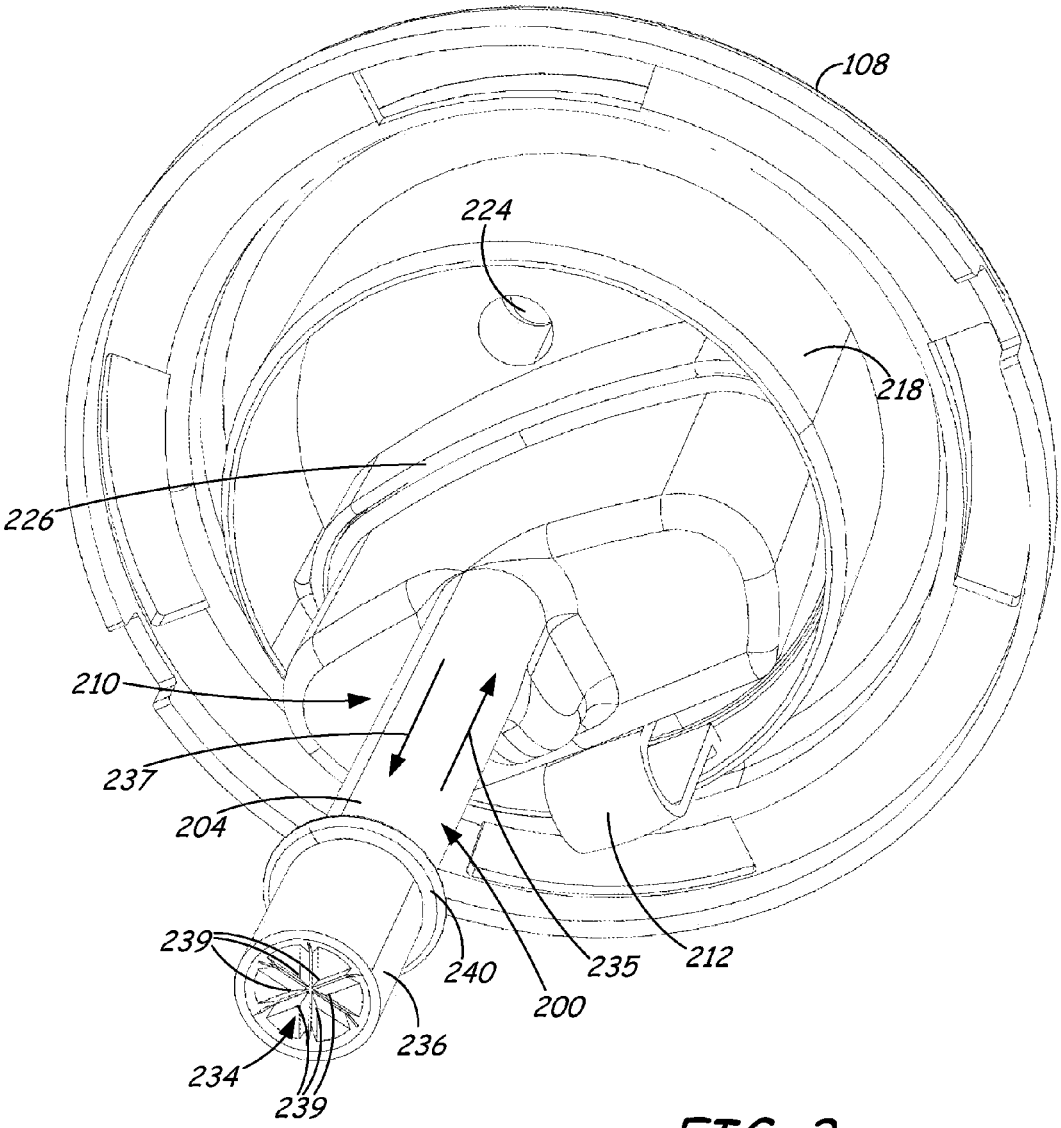
FIG. 3 is a perspective view of a fluid intake assembly, under one embodiment.
Figure 4:
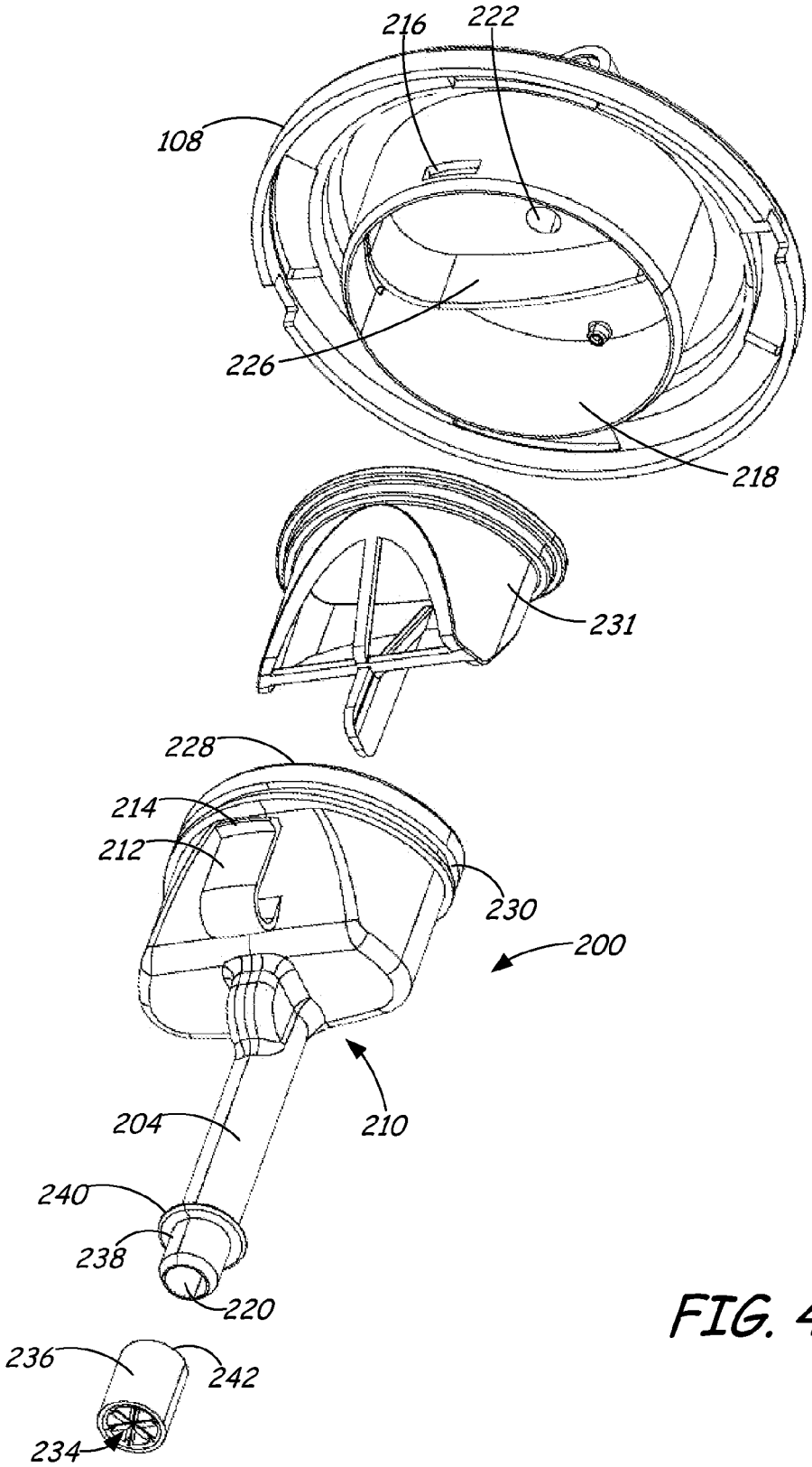
FIGS. 4 and 5 are exploded views of a fluid intake assembly, under one embodiment.
Figure 5:
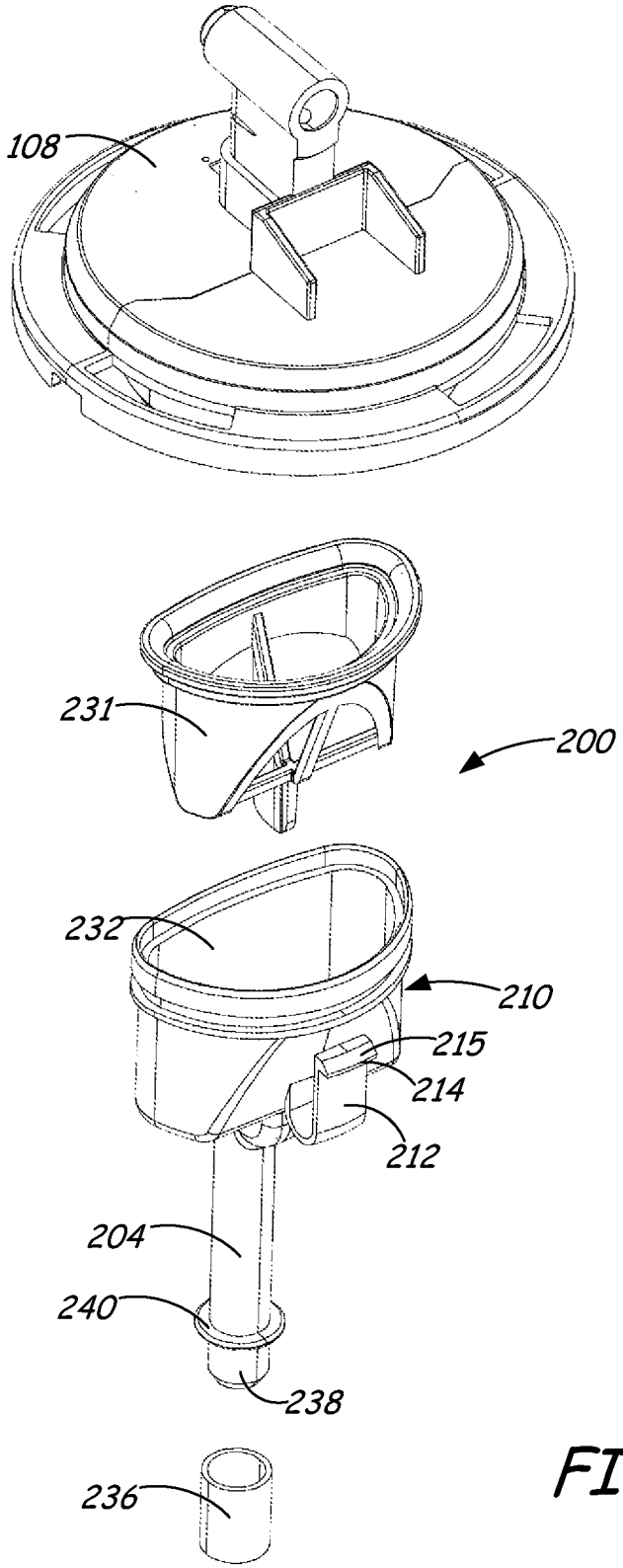

FIG. 3 is a perspective view illustrating one embodiment of assembly 200 and cover 108 of spray gun 100. FIGS. 4 and 5 are exploded views of assembly 200, under one embodiment. Assembly 200 includes a body 210 that is coupled to a portion of spray gun 100 (i.e., cover 108) and extends into container 102. In one embodiment, body 210 includes an inlet suction tube 204 formed of a rigid or semi-rigid material. The shape of the rigid body 210 and tube 204 positions an inlet end 220 (shown in FIG. 4) of tube 204 proximate the bottom of the fluid container (as shown in FIG. 2).

Body 210 defines a fluid path therethrough from inlet end 220 of tube 204 to an inlet port 222 (shown in FIG. 4) of spray gun 100 formed in cover 108. A return port 224 (shown in FIG. 3) provides a return fluid path (e.g., path 206 shown in FIG. 2) to container 102.

In one embodiment, body 210 is removably couplable to cover 108. For example, in one embodiment body 210 includes a locking mechanism 212 that is configured to engage a portion of cover 108. Mechanism 212 comprises a lip or protrusion 214 that extends toward and is received by an aperture 216 formed in an annular ring 218 of cover 108. Annular ring 218 extends from a bottom surface of cover 108 and is configured to engage and form a seal with a portion of container 102, for example. Body 210 is removed from cover 108 by disengaging locking mechanism 212 (i.e., depressing mechanism 212 to remove protrusion 214 from aperture 216). In one embodiment, locking mechanism 212 includes an angled surface 215 that aids in connecting body 210 to cover 108. When connecting assembly 200 to cover 108, surface 215 contacts ring 218 causing deformation of mechanism 212. In this manner, a user is not required to manually depress locking mechanism 212 to attach assembly 200 to cover 108.

In one embodiment, cover 108 includes a wall 226 that extends from the bottom surface of cover 108 and receives body 210. Wall 226 is sized to receive an end 228 of body 210. In one embodiment, a seal mechanism 230 is provided about an outer peripheral surface of body 210 to engage wall 226.

Body 210 is sized to receive a fluid filter 231 within a compartment 232 formed therein. The fluid filter 231 is positioned between body 210 and cover 108 proximate port 222. In this manner, fluid filter 231 is positioned closer to the pump mechanism of the sprayer as compared to fluid intake assembly configurations having the fluid filter positioned at the fluid inlet (e.g., proximate a bottom of the fluid container). Positioning fluid filter 231 in the fluid flow between body 210 and spray gun 100 can improve the fluid suction capabilities (e.g., a reduced pressure drop along the fluid path).

Further, in fluid intake assembly configurations in which the fluid filter is positioned at the fluid inlet of the assembly (e.g., proximate the bottom of the fluid container) the cross-section of the fluid inlet (i.e., the fluid filter) is significantly larger than the cross-section of fluid inlet 220. By way of example, the smaller cross-section of fluid inlet 220 can improve the fluid intake and enable the fluid container to be tilted to greater degrees while keeping the fluid inlet 220 disposed in the fluid material.

Assembly 200 includes a valve mechanism 234 configured to allow fluid flow in a first direction and to resist and/or prevent fluid flow in a second, opposite direction. In the illustrated embodiment, valve mechanism 234 is positioned at the inlet end 220 of body 210 and allows fluid to flow through tube 204 in the first direction (generally illustrated by arrow 235) and prevents fluid from flowing (i.e., returning) through tube 204 in the second direction (generally illustrated by arrow 237), for example when the user releases trigger 114 and/or removes container 102.

In the illustrated embodiment, valve mechanism 234 comprises an end of a cylindrically shaped member 236 configured to be removably received on a tip end 238 of tube 204. Member 236 is sized to be securely retained on tip 238 during use, and is configured to be removable by user if desired (e.g., to replace valve 234, etc.). Tube 204 can include a ring or lip 240 that engages an end 242 of member 236. Lip 240 provides a mechanical stop mechanism for positioning member 236 on tube 204.

Examples of valve mechanism 234 include, but are not limited to, check valves, duckbill valves, flap valves, ball valves, reed valves, and the like. In the illustrated embodiment, valve mechanism 234 is formed of a resilient material (such as an elastomer) and comprises a plurality of portions 239 movable between a neutral, closed position (shown in FIG. 3) and an open position that allows fluid flow into assembly 200. It is noted that the above are examples of valve mechanism 234 and are not intended to limit the scope of the concepts described herein. The valve mechanism utilized in assembly 200 can comprise any suitable mechanism for controlling the fluid flow.

Figure 6:
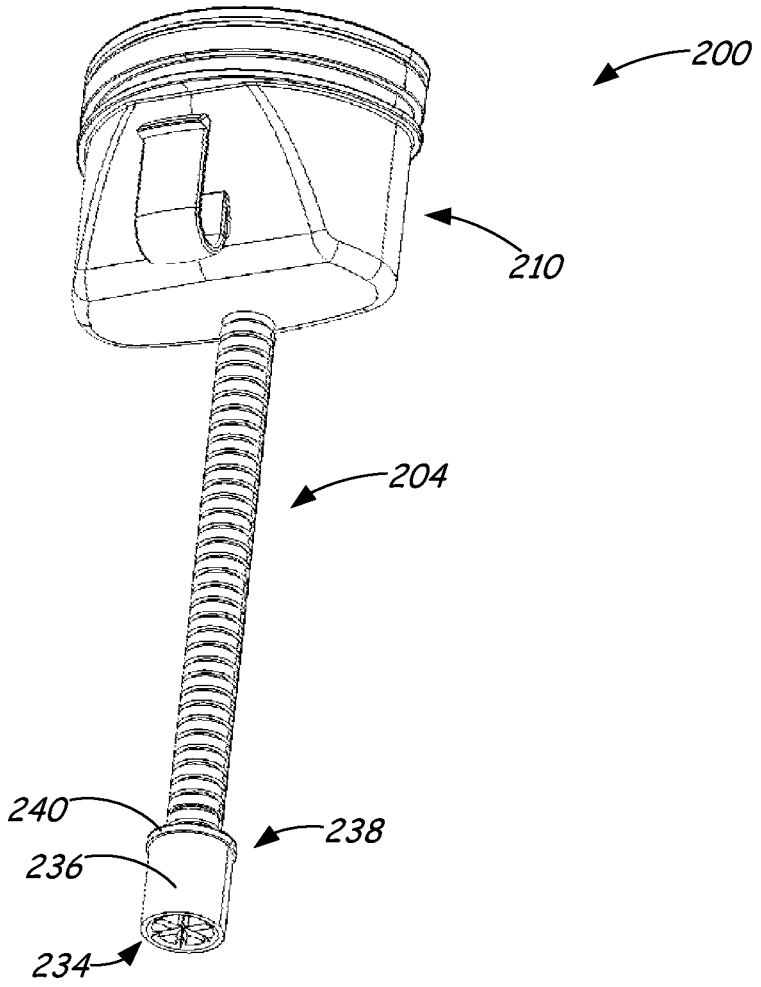
FIG. 6 is a perspective view of a fluid intake assembly having a flexible tube, under one embodiment.

In another embodiment illustrated in FIG. 6, assembly 200 comprises a flexible or semi-flexible tube 204 connected to body 210. Valve mechanism 234 is attached to end 238 of flexible tube 204, which is weighted to maintain end 238 in fluid at the bottom of the fluid container as assembly 200 and the fluid container are tilted at various angles. In one example, a portion of tube 204 proximate end 238 (such as ring or lip 240) is weighted. In another example, a portion of valve mechanism 234 (such as member 236) can be weighted.

Figure 8:
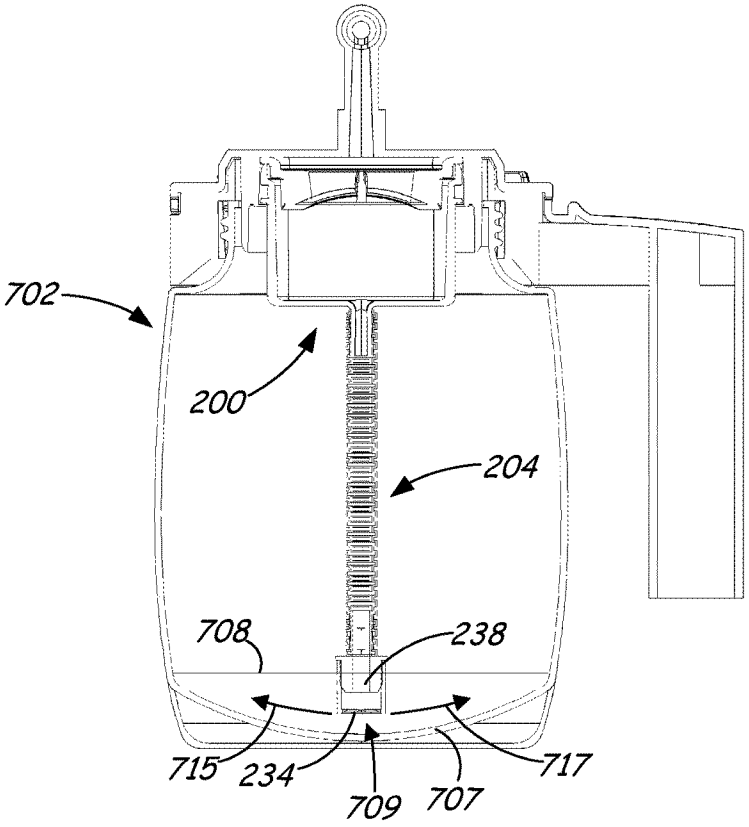
FIGS. 7 and 8 are cross-sectional views of a fluid intake assembly having a flexible tube positioned in a fluid container, under one embodiment.
Figure 7:
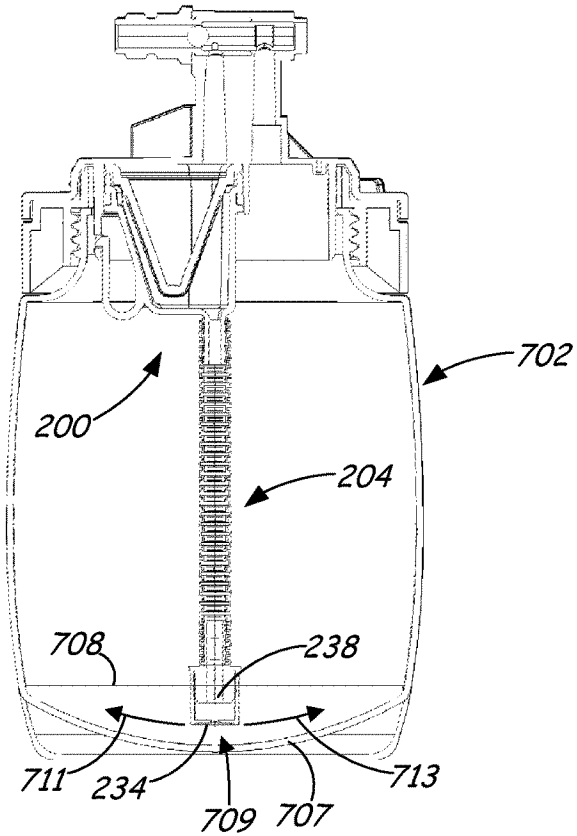

FIGS. 7 and 8 are cross-sectional views illustrating assembly 200 with flexible or semi-flexible tube 204 positioned within an exemplary fluid container 702. In the view illustrated in FIG. 8, container 702 and assembly 200 are rotated approximately 90 degrees with respect to the view illustrated in FIG. 7. In the illustrated embodiment, the length of tube 204 is sized such that end 238 of tube 204 is positioned proximate the bottom surface 707 of container 702 with a small gap 709 between valve mechanism 234 and bottom surface 707. During use, as assembly 200 and container 702 are tilted to various angles tube 204 flexes to some extent allowing end 238 to move within container 702 in various directions represented by arrows 711, 713, 715, 717, for instance, and remain disposed in fluid 708. In one embodiment, the bottom surface 707 of container 702 has a curvature that substantially matches the pendulum swing of tube 204 such that gap 709 is substantially maintained as end 238 moves in directions 711, 713, 715, 717, for instance.

Figure 9:
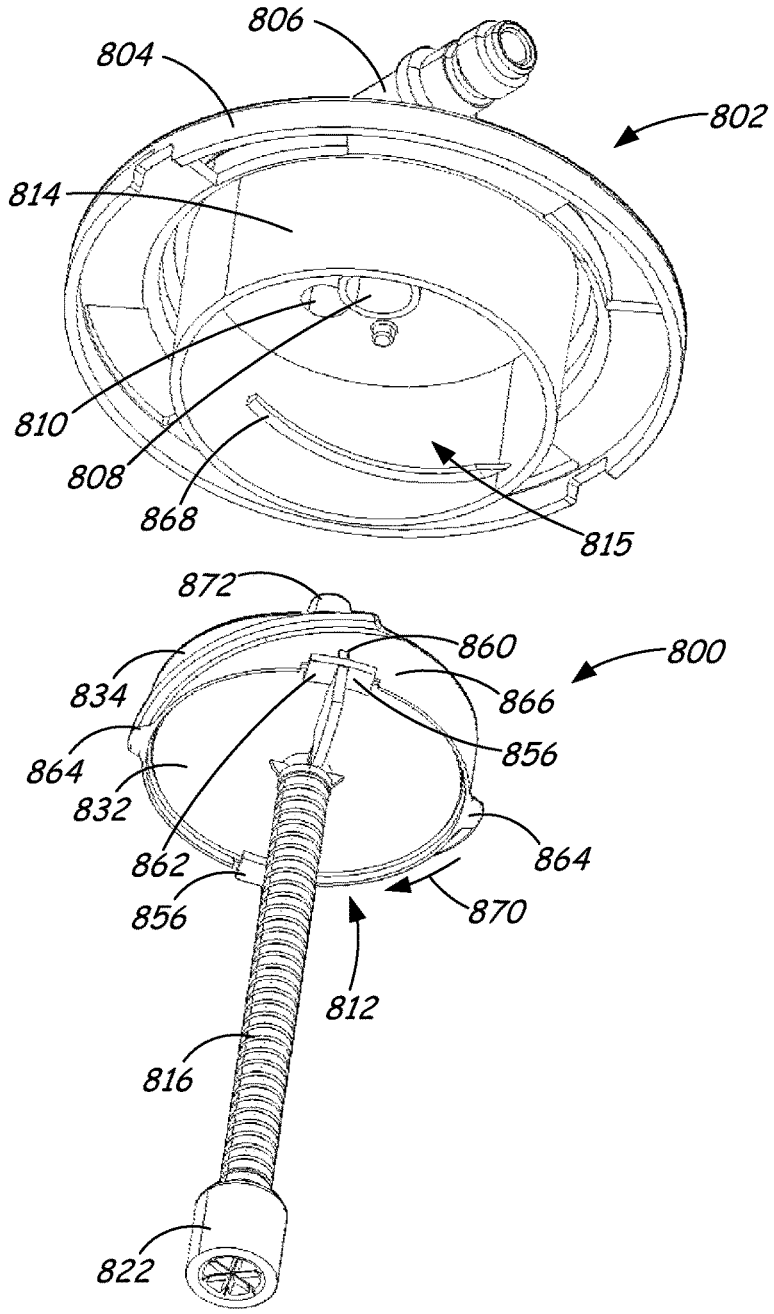
FIGS. 9 and 10 are perspective views of a fluid intake assembly, under one embodiment.
Figure 10:
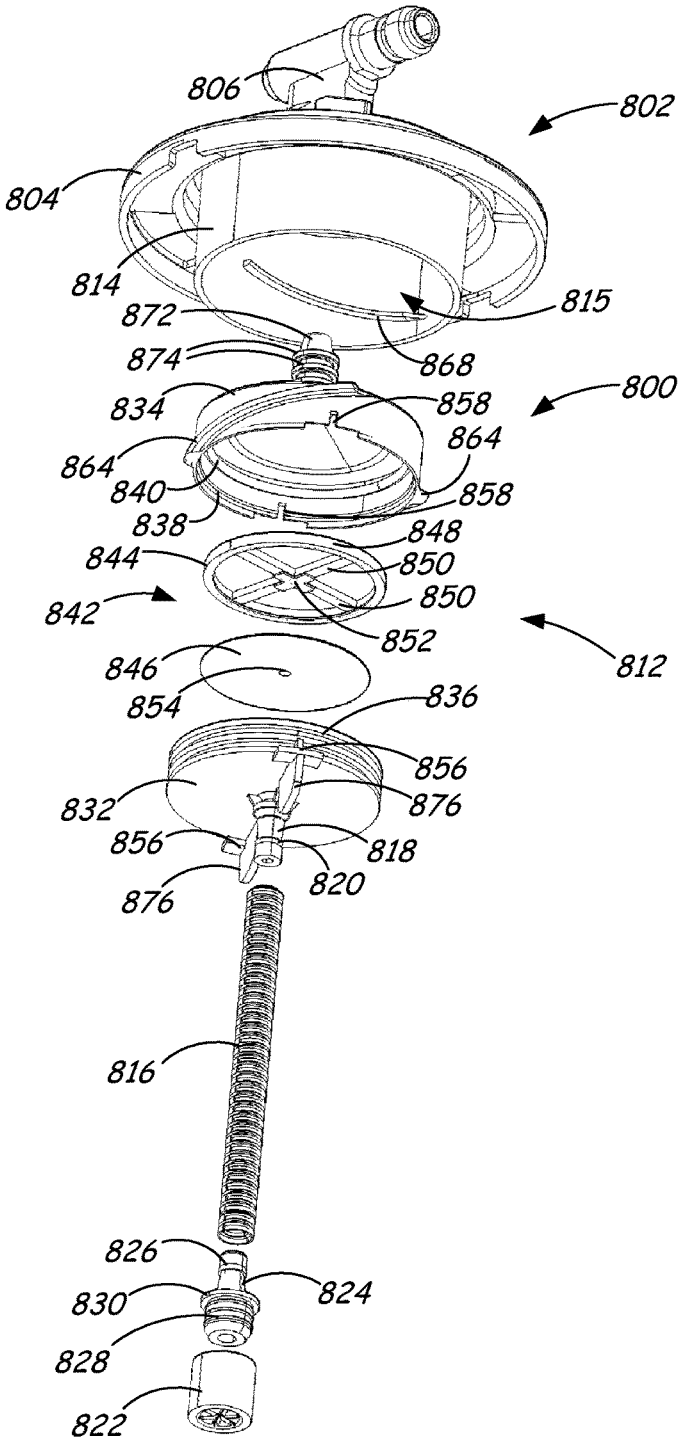

FIGS. 9 and 10 are perspective views of one embodiment of a fluid intake assembly 800. Fluid intake assembly 800 is removably coupleable to a portion 802 of a fluid sprayer (i.e., spray gun 100). In the illustrated embodiment, portion 802 comprises a fluid container cover 804 that is supported by a housing of the sprayer and/or motor/pump assembly disposed within the housing. For instance, a stem 806 extends from cover 804 and is configured to be received within housing 104 of spray gun 100 and provide fluid flow paths between housing 104 and fluid intake assembly 800. An inlet port 808 provides a inlet fluid path from fluid intake assembly 800 to housing 104 and a return port 810 provides a return fluid path from housing 104. In one embodiment, cover 804 is similar to cover 108, illustrated in FIGS. 3 and 4.

Fluid intake assembly 800 includes a main assembly body 812 that is removably coupleable to portion 802. In one embodiment, body 812 is accommodated within a downwardly extending annular ring 814 of portion 802. In the illustrated embodiment, downwardly extending ring 814 has a substantially cylindrical shape. A flexible tube 816 is attached to main body 812. A first end of flexible tube 816 is attached to a tube fitting 818 using one or more barbs or ribs 820 (shown in FIG. 10). In one embodiment, fitting 818 comprises one or more radially protruding frusto-conical barbs that engage inner surfaces of tube 816. A second end of tube 816 supports a valve mechanism 822. In the illustrated embodiment, a second tube fitting 824 is secured to the second end of tube 816 and supports valve mechanism 822. Fitting 824 includes a tube receiving portion 826 and a valve receiving portion 828. Each portion 826 and 828 can include one or more barbs or ribs for securing tube 816 and valve mechanism 822, respectively. For example, the barbs or ribs can include one or more radially protruding frusto-conical barbs. Fitting 824 includes a ring or lip 830 that engages valve mechanism 822 and provides a mechanical stop mechanism for positioning valve mechanism 822 on assembly 800. In one embodiment, ring or lip 830 is similar to ring or lip 240 illustrated in FIGS. 3 and 4. Tube 816 and valve mechanism 822 are illustratively similar to flexible tube 204 and valve mechanism 234, illustrated in FIGS. 6-8.

In the illustrated embodiment, body 812 comprises a first assembly body portion 832 and a second assembly body portion 834. A sealing engagement is formed at the interface of portions 832 and 834 that restricts or prevents air from entering body 812 and the inlet fluid flow. Further, the sealing engagement between portions 832 and 834 can also restrict or prevent fluid from leaking out of body 812. In one embodiment, portion 832 includes one or more features, such as radially protruding barbs or ribs 836, that are configured to engage portion 834. In one embodiment, a sealing mechanism, such as an o-ring and the like, can be retained between two or more ribs 836 and engage and form a seal with portion 834. Alternatively, or in addition, an inner surface of portion 834 can include a sealing mechanism 840, such as an o-ring and the like, formed thereon that is configured to engage portion 832. A ridge 838 that extends along the inner surface of body 834 and aids in securing portion 832 to portion 834 can also be provided.

The first assembly body portion 832 is removably coupleable to the second assembly body portion 834 and retains a fluid filter assembly 842 therebetween. The fluid filter assembly 842 is positioned along with inlet fluid flow through assembly 800 and is configured to remove particles from the fluid. In the illustrated embodiment, fluid filter assembly 842 comprises a fluid filter frame 844 supporting a filter medium 846. Filter medium 846 can comprise any suitable types of filtration materials, such as, but not limited to, paper, foam, mesh and the like.

In the illustrated embodiment, fluid filter frame 844 comprises a ring shaped portion 848 and a plurality of cross-arms 850 attached to and extending within ring shaped portion 848. Arms 850 supports filter medium 846, which is illustratively disc shaped, as the inlet fluid flow passes therethrough. In the illustrated embodiment, filter medium 846 is attached to fluid filter frame 844 using a fastener 852. In one example, fastener 852 includes a protrusion (such as a pin) that extends through an aperture 854 formed in filter medium 846 and is secured to frame 844. In this manner, filter medium 846 can be removed from fluid filter frame 844, for example to clean or replace filter medium 846.

The first assembly body portion 832 includes one or more alignment features 856 that are accommodated by one or more recesses 858 formed in the second assembly body portion 834. Alignment features 856 include a vertically extending projection 860 and horizontally extending projections 862 that are received by corresponding portions of recesses 858. Alignment features 856 provide for rotational alignment of body portion 832 with respect to body portion 834. In this manner, rotation of body portion 832 causes corresponding rotation of body portion 834.

Assembly body 812 can be configured to removably engage portion 802 using any suitable connection mechanisms. In the illustrated embodiment, assembly body 812 is configured to be engaged to, and disengaged from, portion 802 by rotating body 812 with respect to portion 802. In one embodiment, portion 834 comprises one or more threads configured to engage corresponding threads formed on an inner surface of ring 814. The threads can extend along some or all of the inner peripheral surface of ring 814. In the illustrated embodiment, body 834 includes a pair of helical ridges 864. Each ridge 864 extends along only a portion of the outer peripheral surface 866 of body 834. The inner surface of ring 814 includes corresponding helical ridges 868 that are configured to receive ridges 864 and secure body 812 to portion 802 through rotation of body 812 with respect to portion 802.

By way of example, to connect fluid intake assembly 800 to portion 802 body 812 is inserted into opening 815 of ring 814. An inlet port engaging portion 872, illustratively an angled tip, is aligned with inlet port 808. Body 812 is rotated in a direction represented by arrow 870 thereby engaging ridges 864 and 868. As body 812 is rotated, portion 872 is inserted further into port 808. A sealing engagement is formed at the interface of portion 872 and port 808 that restricts or prevents air from entering the inlet fluid flow. Further, the sealing engagement between portion 872 and port 808 can also restrict or prevent fluid leakage from port 808. In one embodiment, portion 872 includes a plurality of radially protruding ribs 874 that are configured to retain a sealing mechanism (not shown in FIG. 10), such as an o-ring and the like, therebetween. The sealing mechanism is configured to engage port 808 and form a seal at the interface of portion 872 and port 808.

Body 832 can include one or more tabs 876 that provide a gripping surface for a user to rotate body 812. The connection structures of body 812 and portion 802 allow fluid intake assembly 800 to be secured to portion 802 by rotating body 812 less than one complete revolution. In one embodiment, body 812 is configured to be secured to portion 802 (such that tip 872 is adequately inserted into inlet port 808) by rotating body 812 less than approximately 90 degrees with respect to portion 802. It is noted that this is one example and is not intended to limit the scope of the concepts described herein.

Figure 11:
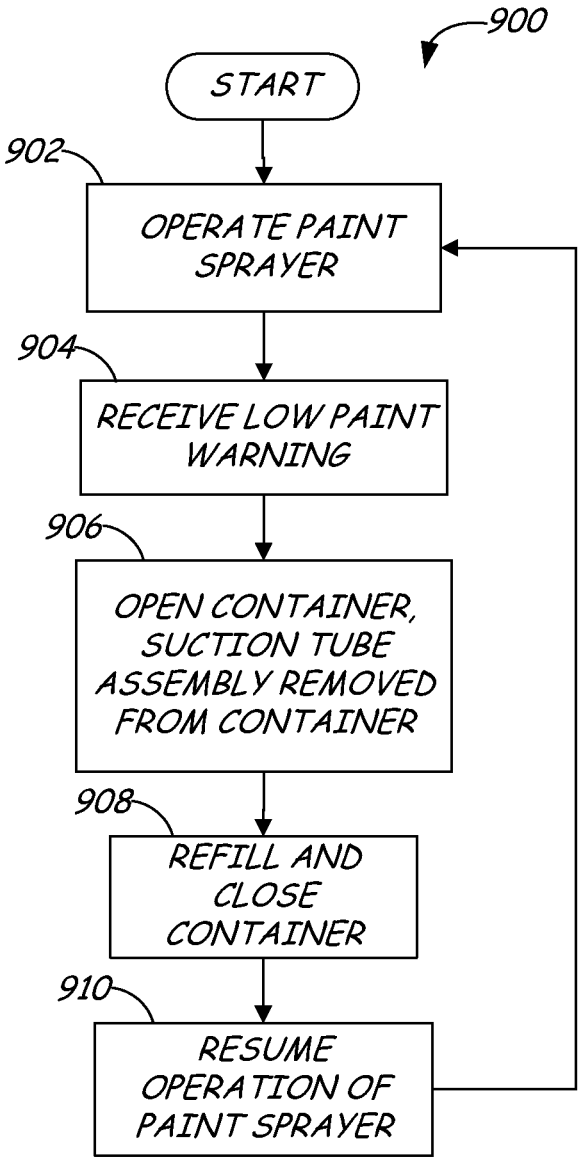
FIG. 11 is a flow diagram illustrating a method for operation of a paint sprayer, under one embodiment.

FIG. 11 is a flow diagram illustrating a method 900 for operation of a paint sprayer, under one embodiment. For illustration purposes, method 900 will be described in the context of spray gun 100 and assembly 200 discussed above, which is not intended to limit the scope of the concepts described herein. Method 900 can be utilized with other types of fluid sprayers and fluid intake mechanisms, for instance.

At step 902, spray gun 100 is operated by the user to spray paint supplied from fluid container 102. A low paint warning is received at step 904. In one embodiment, the low paint warning comprises a fluid level indicator that indicates when a level of paint in fluid container 102 reaches and/or falls below a threshold level (e.g., five percent, ten percent, twenty percent, etc.). At step 906, the user suspends operation of spray gun 100 to refill container 102. For instance, in one embodiment the user decouples container 102 from spray gun 100 and removes suction tube assembly 200 from container 102. The valve mechanism 234 prevents fluid material in tube 204 from emptying back into fluid container 102 and restricts air from entering the inlet 220. Assembly 200 operates to retain fluid material in housing 210 and tube 204. During subsequent use at step 910 (e.g., after the user has refilled container 102 at step 908 and placed assembly 200 back into the fluid in container 102), valve mechanism 234 is disposed within the fluid in container 102 and spray gun 100 is operated with little or no air entering the fluid inlet 202.

While various embodiments of the invention have been set forth in the foregoing description, together with details of the structure and function of various embodiments of the disclosure, this disclosure is illustrative only, and changes may be made in detail, especially in matters of structure and arrangement of parts within the principles of the present disclosure to the full extent indicated by the broad general meaning of the terms in which the appended claims are expressed. For example, the particular elements may vary depending on the particular application for the system or method while maintaining substantially the same functionality without departing from the scope and spirit of the present disclosure and/or the appended claims.

What is claimed is:

1. A handheld paint sprayer comprising:

a housing containing electrical components configured to control operation of the sprayer;

a paint pump assembly;

an electric drive operably coupled to drive the paint pump assembly;

a trigger configured to control operation of the sprayer;

a handle configured to enable a user to hold the sprayer during operation;

a paint container carried on the sprayer; and an intake assembly configured to provide a paint flow path between the paint container and the paint pump assembly, the intake assembly comprising:

an inner assembly portion comprising a plurality of alignment features;

an elongate tube comprising a first end disposed within the paint container and a second end fluidically coupled to the inner assembly portion;

a valve mechanism fluidically coupled to the first end of the elongate tube, and configured to restrict a flow of air from mixing with a flow of paint within the paint flow path;

an outer assembly portion to engage the plurality of alignment features of the inner body portion at a first end, and fluidically couple a paint inlet port with a port engaging portion disposed at a second end, wherein the paint inlet port is configured to provide the paint flow path from the elongate tube to the paint pump assembly;

a fluid filter assembly positioned in the paint flow path at an interface between the inner assembly portion and the outer assembly portion such that the fluid filter assembly is removable from the interface by disengaging the plurality of alignment features; and a mounting mechanism comprising a sealing engagement formed at an interface between the port engaging portion of the outer assembly portion and the paint inlet port, the mounting mechanism being configured to removably couple the intake assembly with the pump assembly such that the intake assembly is removable from the paint sprayer and the sealing engagement prevents air from entering the paint flow path during operation of the sprayer.

2. The handheld paint sprayer of claim 1, wherein the valve mechanism is configured to allow a flow of paint in a first direction through the elongate tube and restrict a flow of paint in a second, opposite direction through the elongate tube.

3. The handheld paint sprayer of claim 1, wherein the elongate tube comprises a flexible tube extending toward a bottom surface of the fluid container, the bottom surface of the fluid container having a curvature corresponding to a pendulum swing of the flexible tube.

4. The handheld paint sprayer of claim 1, and further comprising a cover portion supported relative to a sprayer body and removably coupleable to the paint container, wherein the first outer body portion is threadably couplable to the cover portion.

5. The handheld paint sprayer of claim 1, wherein the valve mechanism is configured to be removably received by a user from a tip end of the paint flow path.

6. The handheld paint sprayer of claim 1, wherein the valve mechanism comprises an integral body having a sidewall portion that extends along a portion of a length of the tube and is configured to retain the valve mechanism on the tube.

7. The handheld paint sprayer of claim 6, wherein the sidewall portion has an inner surface configured to frictionally engage an outer surface of the tube to retain the body on the tube.

8. The handheld paint sprayer of claim 1, wherein the elongated tube comprises an enlarged diameter portion configured to engage and locate the valve mechanism on the tube.

9. The handheld paint sprayer of claim 1, wherein the intake assembly comprises a flexible tube extending toward the bottom surface of the paint container, the bottom surface of the paint container having a curvature corresponding to a pendulum swing of the flexible tube.

10. The handheld paint sprayer of claim 1, wherein the fluid intake assembly comprises at least one of a check valve, duckbill valve, flap valve, ball valve, reed valve, and a star valve having a plurality of portions formed of a resilient material and movable between a first, closed position and a second, open position.

11. The handheld paint sprayer of claim 1, and further comprising a paint level indicator configured to provide feedback to the user indicative of a level of paint in the paint container being below a threshold level.

12. The handheld paint sprayer of claim 1, wherein the plurality of alignment features of the inner assembly portion comprise at least one of a horizontal projection and a vertical projection.

13. The handheld paint sprayer of claim 12, wherein the outer assembly portion further comprises:

a recessed portion configured to engage at least one of the horizontal projection and the vertical projection.

14. The handheld paint sprayer of claim 12, wherein the at least one of the horizontal projection and the vertical projection are configured to provide rotational alignment of the inner assembly portion with respect to the outer assembly portion.

15. The handheld paint sprayer of claim 1, wherein the sealing engagement comprises a plurality of radially protruding ribs.

16. The handheld paint sprayer of claim 15, wherein the plurality of radially protruding ribs are configured to receive an o-ring that prevents air from entering the paint flow path during operation of the sprayer.

* * * * *